United States Patent [19]

Bricker et al.

[11] 4,369,028

[45] Jan. 18, 1983

[54] PHOTOFLASH LAMP

[75] Inventors: Daniel W. Bricker; John W. Shaffer, both of Williamsport, Pa.

[73] Assignee: GTE Products Corporation, Stamford, Conn.

[21] Appl. No.: 744,540

[22] Filed: Nov. 24, 1976

[51] Int. Cl.[3] ..... F21K 5/02

[52] U.S. Cl. ..... 431/362

[58] Field of Search ..... 431/95, 95 A, 362; 149/44

[56] References Cited

U.S. PATENT DOCUMENTS

| | | | |
|---|---|---|---|
| 2,651,189 | 8/1953 | Beese | 431/95 |
| 2,783,632 | 3/1957 | Eppig | 431/95 |
| 3,312,085 | 4/1967 | Schilling et al. | 431/95 |
| 3,904,451 | 9/1975 | Rainone | 149/44 |
| 3,914,143 | 10/1975 | Sterling | 149/44 |
| 3,969,067 | 7/1976 | Schupp | 431/95 |
| 3,972,673 | 8/1976 | Schupp | 431/95 |
| 4,059,389 | 11/1977 | Armstrong et al. | 431/95 |

*Primary Examiner*—Carroll B. Dority, Jr.
*Attorney, Agent, or Firm*—Edward J. Coleman

[57] ABSTRACT

A high-voltage type photoflash lamp having an ignition structure including an improved primer material for the reliable ignition of filamentary combustible material distributed within the oxygen-filled envelope of the lamp. The primer material comprises a particulate fuel such as zirconium powder, a binding agent such as nitrocellulose, and an additive of finely divided inert material which is insoluble and nonconductive and has a particle size of less than about five microns diameter.

14 Claims, 3 Drawing Figures

PHOTOFLASH LAMP

BACKGROUND OF THE INVENTION

This invention relates to photoflash lamps and, more particularly, to flashlamps of the type containing a primer bridge, or the like, ignited by a high voltage pulse.

Such flashlamps typically comprise a tubular glass envelope constricted and tipped off at one end and closed at the other end by a press seal. A pair of lead-in wires pass through the glass press and terminate in an ignition structure including a glass bead, one or more glass sleeves, or a glass reservoir of some type. A mass of primer material contained on the bead, sleeve or reservoir bridges across and contacts the ends of the lead-in wires. Also disposed within the lamp envelope is a quantity of filamentary metallic combustible, such as shredded zirconium or hafnium foil, and a combustion supporting gas, such as oxygen, at an initial fill pressure of several atmospheres.

Lamp functioning is initiated by application of a high voltage pulse (e.g., several hundred to several thousand volts, for example, from a piezoelectric crystal) across the lamp lead-in wires. The mass of primer within the lamp then breaks down electrically and ignites; its deflagration, in turn, ignites the shredded combustible which burns actinically.

A considerable amount of prior development effort has been carried out in the area of ignition structures and primer materials for high voltage flashlamps. For example a copending application, now issued as U.S. Pat. No. 4,059,388 and assigned to the present assignee, describes a primer material comprising a mixture of combustible metal powder, one or more metal oxides, and a binding agent, but which is free of oxidizer salts. In this instance, the metal oxides function as an oxygen donor. Another copending application, now issued as U.S. Pat. No. 4,059,389 and assigned to the present assignee, describes a beadless ignition structure comprising a pair of spaced-apart lead-in wires with spherically shaped terminations, a glass frit coating over the lead-in wires, and a coating of primer material over the frit-coated terminations. The primer may bridge the wire terminations or comprise separate spaced apart coatings on the respective terminations, with the filamentary combustible being in contact with both terminations to provide a conducting path therebetween. A primer composition is described which comprises about 99.0 percent by weight of zirconium powder and 1.0 percent by weight cellulose nitrate on a dried basis.

Improved primer materials for high voltage type flashlamps are also described in U.S. Pat. Nos. 3,972,673 and 3,969,067. The primer material of the former comprises a solid mixture of combustible fuel and an oxidizer for the fuel, such as an alkali metal chlorate or perchlorate, and further contains a combustion supporting oxide of the type which is converted to a lower oxide upon combustion of the mixture. More particularly, the patent indicates that certain metal oxide additives in this solid primer mixture promote a more complete combustion of the primer fuel. It is hypothesized that the additive is partially reduced through chemical reaction taking place when the lamp is flashed to provide a source of oxygen which is readily available for combustion of the primer fuel by reason of the oxygen being generated in the solid mixture. The specific combustion-supporting oxides indicated as suitable for this application comprise $Co_3O_4$, $BaCrO_4$, $Fe_2O_3$, and the higher oxides of nickel. A preferred primer material composition is given as comprising a solid mixture, in percentages by weight of 46.1 percent zirconium, 14.5 percent sodium chlorate, 31.7 percent $Co_3O_4$, and 7.7 percent $BaCrO_4$, and further containing between 1–5 percent of a water soluble polymer binder such as polyvinyl alcohol or polyvinyl pyrrolidone.

The second patent mentioned above, namely, U.S. Pat. No. 3,969,067, describes an improvement over the primer material discussed above in that the composition further includes an alumina gel additive in an amount from about 0.25–2.0 percent by weight of the solid mixture. The patent indicates that this additive modifies the operation of the primer material to promote less sensitivity to premature accidental ignition from ambient electrostatic charges without requiring an increase in the maximum energy provide by the firing pulse.

Previous primers we have employed for high voltage flashlamps have shown a behavior and sensitivity that is quite strongly influenced by the nature and idiosyncrasies of the particular lot of zirconium powder used. Upon studying the behavior of different zirconium lots in primers for high voltage flashlamps and attempting to correlate behavior with the known variables of the zirconium powder (e.g., particle size, purity, percent weight gain upon ignition, burning rate, and the levels of many specific chemical impurities present such as H, O, Fe, Mg, Si, N, Al, Ca), no clear relationship was found that would account for the observed variations in performance. For example, two different lots of zirconium powder manufactured from the identical raw materials and which are analytically similar may give vastly different levels of reliability when they are used in primer and fabricated into high voltage flashlamps. For reasons that are indeterminate, the zirconium powder appears to vary in ignitability.

In the earlier filament type flahslamps, differences in zirconium powder lots were recognized but the major effect that showed up had to do with variations in lamp output peak time. The ignition means in such lamps, e.g., mere heating of the primer in contact with a hot filament until ignition occurs, is sufficiently non-critical that actual primer ignition failure, rarely, if ever, was observed.

In contrast, the primer in high voltage flashlamps must function positively upon passage of a few microjoules of electrical energy in a pulse that lasts only for microseconds. The zirconium powder used in such primers must ignite reliably and sustain ignition upon such feeble and momentary heating. Consequently, the apparently inevitable differences that occur in zirconium powder from one manufactured lot to another are no longer a nuisance factor but rather can mean the difference between correct functioning and actual lamp failure.

It is obvious in such a situation that selection of zirconium lots for use in high voltage primer is a possible solution to the dilemma. This in fact has been done, so that only the best and most readily ignitable zirconium powder is used in high voltage flashlamps. In spite of such lot selection, however, slight differences in sensitivity and behavior are still detectable from one lot to another. This appears to be especially true in the safe, oxidizer-free primers that are favored for manufacturing use and which have been disclosed in the aforementioned U.S. Pat. No. 4,059,389.

SUMMARY OF THE INVENTION

In view of the foregoing, it is an object of this invention to provide an improved photoflash lamp with a more reliable ignition means.

A particular object of the invention is to provide a primer for high voltage type photoflash lamps that has an increased reliability which is not critically dependent on the normally encountered variations in the different parameters of the combustible metal powder used.

Another object is to provide a primer modification for high voltage type photoflash lamps that achieves faster lamp peak times with safe, oxidizer-free primers than are usually attainable with such primers.

These and other objects, advantages and features are attained, in accordance with the principles of this invention, by the surprising discovery that the electrical sensitivity and reliability of the primer material for high voltage flashlamps can be substantially increased by the addition of finely subdivided inert materials which are insoluble and nonconductive and have a particle size of less than about 5 microns diameter. Particularly preferred as the additive is an inert refractory material having a particle size much less than 0.5 micron, such as the materials commercially known as fumed silica, alumina, or titania.

The addition of such materials to a lamp primer would be expected, by those skilled in the art, to both desensitize the material and to slow its burning rate. Surprisingly, however, not only is the reliability and uniformity enhanced so that zirconium powder lot differences are rendered essentially non-critical, but also the lamp peak times attained with such refractory modified primers are actually faster than for similar lamps with unmodified primer. The peak time for lamps of the oxidizer-free primer type is decreased by from 1 to 2 milliseconds.

The chemical nature of the inert material additive does not appear to be related to the beneficial effects observed. For example, among the types of additive materials successfully used are titanium dioxide, aluminum oxide, silicon dioxide, aluminum silicate clays, and magnesium oxide. It has become apparent that it is the particle size, and not the chemical reactivity, of the additive that is the influential parameter. As particle size decreases, the effectiveness of any given inert additive material increases. As mentioned above, the most effective materials are those formed by, e.g., flame hydrolysis of halides of elements to give rise to particles of about 0.01 to 0.02 micron diameter. Such materials are known commercially as fumed silica, alumina, or titania, etc.

The sub-micron inert additive material is particularly useful in the primers for high voltage type flashlamps, whether the primer bridges the inleads of the lamp or is disposed as spaced apart beads on the inlead terminations, such as described in the aforementioned U.S. Pat. No. 4,059,389. Further, the additive is useful for providing the above-described improvements in primer material compositions which include solid oxidizers, in primer compositions which are oxidizer-free such as described in the aforementioned U.S. Pat. No. 4,059,389, and in primer compositions which are free of oxidizer salts but include one or more metal oxides as the oxygen donor, such as described in the aforementioned U.S. Pat. No. 4,059,388. With respect to the last-mentioned primer composition, a metal oxide employed as the inert additive of the present invention would distinguish from the metal oxide employed as the oxygen donor in that the particle size and weight proportion of the additive would be very substantially less than that of the oxygen donor.

The particles of the inert additive of the invention are so fine as compared to the zirconium particles that they become distributed in the interstices between the larger zirconium particles of the final mixture, thereby providing dielectric interfaces separating the conductive zirconium particles which effect an increase in the resistance of the electrical path through the primer material. Accordingly, the dramatic sensitivity gains through the addition of inert materials to the primer, as disclosed herein, are thought to be related to the post-breakdown electrical resistance increase provided by the additives. The higher electrical resistance during conduction of the high voltage pulse through the primer appears to result in better source impedance matching and thereby dissipation of a greater percentage of the available pulse energy into the primer mass. That is, the higher impedance of the primer load causes a greater fraction of the ignition circuit energy to be dissipated internal to the primer. As a result a significant increase in reliability is provided, especially when the circuit external to the lamp has a resistance of greater than a few hundred ohms, or when the pulse source has high impedance such as the piezoelectric sources employed in currently available cameras for use with high voltage type flashlamp arrays.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
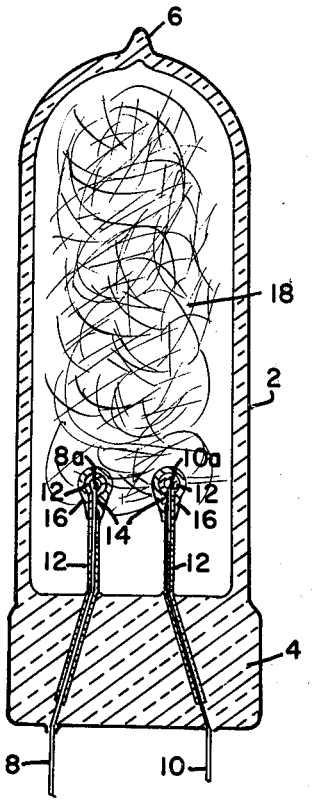
FIG. 1 is an enlarged sectional view of one embodiment of a photoflash lamp in accordance with the invention, wherein primer coatings on the lead-in wires are spaced apart without bridging.
Figure 2:
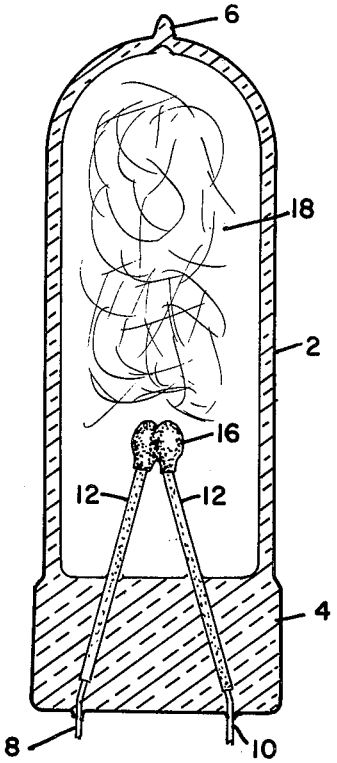
FIG. 2 is an enlarged sectional view of a variation of the lamp of FIG. 1, wherein the lead-in wires are bridged with primer.

FIGS. 1 and 2 illustrate fritted lead photoflash lamps of the type described in the aforementioned U.S. Pat. No. 4,059,389, except that the primer material 16 has a composition in accordance with the present invention. Referring to FIG. 1, the high voltage type flashlamp illustrated therein comprises an hermetically sealed light-transmitting envelope 2 of glass tubing having a press 4 defining one end thereof and an exhaust tip 6 defining the other end thereof. Supported by the press 4 is an ignition means including a pair of metal lead-in wires 8 and 10 extending through and sealed into the press in a spaced apart relationship. The ends of the lead-in wires within the envelope are provided with smooth and rounded terminations 8*a* and 10*a* of substantially spherical shape. The diameter of each termination preferably is about 2 to 3 times the diameter of the remainder of the wire. The surfaces of the lead-in wires and their terminations in the envelope are coated with an insulating material of glass frit 12. The frit glass should have a mean coefficient of thermal expansion which substantially matches that of the glass envelope 2, and preferably, the glass compositions of the frit and the envelope are the same. In this manner a good glass-to-metal seal is provided in the press area 4, where the frit coating 12 typically extends along the leads.

A selected portion 14 on each lead-in wire adjacent to the spherical termination thereof is uncoated with the glass frit insulating material so as to expose a small area of bare metal wire through coating 12. The ignition structure is completed by a coating of primer material 16 over the spherical terminations 8*a* and 10*a* and portions of the adjacent wire. More specifically, the primer material 16 is disposed over the glass frit coating 12 and must cover the uncoated bare wire portions 14. The respective coatings of primer material 16 on the lead-in wires 8 and 10 are spaced apart from each other. FIG. 2 illustrates an alternative approach wherein the primer material 16 bridges the terminations of the lead-in wires.

Typically the lamp envelope 2 has an internal diameter of less than one centimeter and an internal volume of less than one cubic centimeter. A quantity of filamentary combustible fill material 18, such as shredded zirconium or hafnium foil, is disposed within the lamp envelope. The envelope 2 is also provided with a filling of combustion supporting gas such as oxygen at a pressure of several atmospheres. Typically, the exterior surface of the glass envelope 2 is also provided with a protective coating such as cellulose acetate (not shown).

In accordance with the present invention, we have discovered, quite unexpectedly, that a highly sensitive and reliable primer for high voltage type, miniature flashlamps can be provided by the use of an additive of finely divided inert material which is insoluble and non-conductive and has a particle size or less than about 5 microns diameter, and preferably of submicron size. For example, primer material 16 may be provided by mixing a particulate fuel, typically a combustible metal powder such as zirconium, with a small percentage of the inert additive, and a binding agent such as nitrocellulose in a suitable solvent, for example, amyl acetate. The resultant primer mixture is then applied, such as by a dip process. For example, after press sealing the lead-in wires into the lamp and prior to filling with shreds and oxygen, the end portions of the frit coated lead-in wires are dipped into a primer cup which passes through the open end of the glass tubing, so as to apply the coating 16 of the primer material about the wire terminations, as shown in FIGS. 1 and 2. When dried, the primer shows substantially increased ignition sensitivity for high voltage discharge therethrough.

Alternatively, a thermite-type primer, such as described in the aforementioned U.S. Pat. No. 4,059,388, may be employed. In this instance, the above noted primer mixture further includes one or more metal oxides from the group of metals cobalt, tungsten, manganese, nickel and/or copper. The proportion of metal oxides can be from about 1 to 130 percent of the stoichiometric quantity required for chemical reaction with the combined metal fuels in the mixture. That is, the amount of metal oxide used should fall within plus 30 percent or minus 99 percent of the calculated stoichiometric quantity required for thermite-type reaction with all the metal powder used. This thermite-type composition increases the breadkdown voltage of the primer as compared to oxidizer salt primers so as to preculde inadvertent simultaneous flashing of array lamps due to high voltage leakage paths in the interconnecting structure of the circuitry. The fuel portion of the mixture may also include magnesium powder as an additive to lower the electrical breakdown voltage where some degree of adjustment ot the electrical voltage sensitivity of the primer is desired. For example, the magnesium powder content may be from 0 to 30 percent by weight on a dried basis.

Yet a further alternative, although not as desirable, comprises the use of an oxidizer, such as sodium chlorate or potassium chlorate, along with the mixture of combustible metal powder, inert additive, and binder.

Operation of the high voltage flashlamps of FIGS. 1 and 2 is initiated when a high voltage pulse from e.g., a piezoelectric crystal, is applied across the two lead-in wires 8 and 10. Electrical breakdown of the primer causes its deflagration which, in turn, ignites the shredded metallic combustible 18. The scraped off portions 14 on the lead-in wires insure reliability of ignition by providing small areas of direct contact between the bare conductor metal and the primer. It has been observed, however, that reliable ignition can also be obtained if the scraping step is eliminated and the wires 8 and 10 within the envelope are left completely coated with frit 12, without providing non-coated areas 14. It is theorized that such ignition is affected due to the somewhat porous nature of the upper portions of the frit coating which are not completely fused, as discussed in the aforementioned U.S. Pat. No. 4,059,389.

In the lamp of FIG. 2, the spark discharge occurs through the primer bridge 16, and the shreds of foil 18 will tend to be supported in the upper portions of the envelope above the bridge. In the lamp of FIG. 1, however, the foil 18 substantially fills the envelope 2 and is in contact with both of the respective primer coatings 16 so as to form an electrically conducting path therebetween for formation of a spark discharge between the lead-in wires and the foil through the respective primer coatings upon application of a high voltage pulse across the lead-in wires. Hence, in high speed automatic production processing, it is not critical whether the primer bridges the leads or not; it is only necessary that the foil provides contact between the separate primer coatings.

Figure 3:
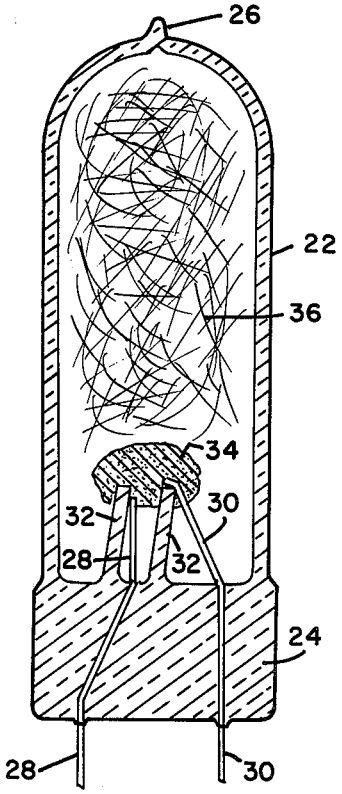
FIG. 3 is an enlarged sectional view of another embodiment of a photoflash lamp in accordance with the invention, wherein one of the lead-in wires has a glass sleeve.

Referring now to the alternative embodiment of FIG. 3, the high voltage type flashlamp illustrated therein comprises an hermetically sealed light-transmitting envelope 22 of glass tubing having a press 24 defining one end thereof and an exhaust tip 26 defining the other end thereof. Supported by the press 24 is an ignition means comprising a pair of lead-in wires 28 and 30 extending through and sealed to the press, an insulating sleeve 32 extending within the envelope about the lead-in wire 28, and a mass of primer material 34 bridging the ends of the lead-in wires within the envelope. The insulating sleeve 32 may be formed of glass or ceramic and is preferably sealed into the envelope press 24 at one end so that only the inward end of the sleeve is open. Lead-in wire 30 passes through the press 24 and is formed so that it rests and terminates at or near the opened end of the sleeve 32. The mass of primer material 34, which may be dip applied, is disposed to substantially cover the open end of the sleeve 32 and bridge the ends of the lead-in wires, as shown in FIG. 3. In accordance with the invention, the composition of primer material 34 includes a finely divided inert additive material as described hereinbefore with respect to primer material 16 in FIGS. 1 and 2.

Typically the lamp envelope 22 has an internal diameter of less than one centimeter and an internal volume of less than 1 cc. A quantity of filamentary combustible fill material 36, such as shredded zirconium or hafnium foil, is disposed within the lamp envelope. The envelope 22 is also provided with a filling of combustion supporting gas, such as oxygen, at a pressure of several atmospheres. Typically, the exterior surface of the glass envelope 22 is also provided with a protective coating, such as cellulose acetate (not shown).

As described for the lamp of FIG. 1, a wet primer mixture may be prepared and then applied, such as by a dip process, to form the ignition mass 34. When dried, the primer shows high ignition sensitivity for high voltage discharge across the lead-in wires.

Operation of the lamp is initiated when a high voltage pulse, from e.g., a piezoelectric crystal, is applied across the two lead-in wires 28 and 30. Electrical breakdown of the primer causes its deflagration which, in turn, ignites the shredded metallic combustible 36.

Among the types of inert additive materials successfully used in accordance with the invention are titanium dioxide, aluminum oxide, silicon dioxide, aluminum silicate clays, and magnesium oxide. As previously discussed, it is the particle size, and not the chemical reactivity, of the additive that is the influential parameter. As particle size decreases, the effectiveness of any given additive material increases. The most effective materials are those formed by, e.g., flame hydrolysis of halides of elements to give rise to particles of about 0.01 to 0.02 micron diameter. Such materials are known commercially as fumed silica, alumina, or titania, etc.

As a maximum, the average particle size of the additive used should be less than about 5 microns, and preferably less than 1 micron. As stated above, the greatest beneficial effects per unit additive used are attained with materials having an average particle size below 0.5 micron. The additive used may be present to the extent of from 0.1 to 20.0 percent by weight on a dried basis. We prefer to use from 1 to 10 percent and find that from 3 to 6 percent is optimum. The additive should be nonsoluble in the solvent system used and should be electrically non-conductive. The additive may be non-combustible, as are the refractory oxides mentioned, although the fact of non-combustibility is not intended to be limiting but rather merely of great surprise and interest.

By way of specific example, glass lamps such as those illustrated in FIG. 3 were provided with an envelope 22 formed from 0.264 inch O.D. tubing of borosilicate glass known commercially as Corning Type 7073 glass. The internal volume was 0.35 $cm^3$; the quantity of combustible material 36 was 11.5 milligrams 4 inch long of zirconium shreds having a cross section of 0.0008"×0.0010"; the oxygen fill pressure was 950 cm. Hg. absolute. The lead-in wires 28 and 30 were 0.14" diameter and formed of a metal alloy of iron, nickel and cobalt which is known commercially as Rodar or Kovar; the insulating sleeve was 0.200" long, hard glass tubing having an O.D. of 0.073" and an I.D. of 0.027". Approximately, 2 mgs. of primer material 34 having a composition as denoted in the table below was used in each lamp. The lamps were coated with four coats of reinforcing cellulose acetate lacquer of about 0.012 inch thickness. The lamps were flashed from a piezoelectric source providing an output pulse of about 2000 volts. The following tests were performed using control and test lamps with the respective primer compositions indicated.

I. Photometric Test

Control primer (dried): 98.9% Zr, 1.1% nitrocellulose Test Primer (same Zr lot): 93.5% Zr, 1.5% nitrocellulose, 5.0% hydrophobic fumed silica

| Primer | No. Lamps | Peak Time msec. | Light Output (lum-sec.) 0–25 msec. | Total |
|---|---|---|---|---|
| Control | 30 | 13.8 | 3725 | 4405 |
| Test | 30 | 12.3 | 3806 | 4329 |

This representative test clearly shows the reduction in lamp peak time achieved by adding finely divided refractory powder to the primer.

II. Photometric Test

Two additional lamp groups were prepared using fumed alumina and nonhydrophobic-treated fumed silica as the primer additives at the same 5% by weight loading as before.

| Additive | No. Lamps | Peak Time msec. | Light Output (lum-sec.) 0–25 msec. | Total |
|---|---|---|---|---|
| Alumina | 21 | 8.9 | 4109 | 4417 |
| Silica | 20 | 8.4 | 3895 | 4143 |

III. "Poor" Zirconium Reliability Test

Lamps as described were prepared using primer made from a very poor lot of zirconium powder. The control and test primer formulations are as given in Photometric Test I, the test primer again being modified with 5% by weight hydrophobic fumed silica.

| Primer | No. Lamps | No. Flashed | % Reliability |
|---|---|---|---|
| Control | 68 | 32 | 47 |
| Test | 402 | 402 | 100 |

The particular zirconium powder lot represented here was completely unacceptable for use in high voltage flashlamp primer. Repeat tests of that lot using various fine particle size additives, as disclosed herein, and using many thousands of lamps, have solidly confirmed the benefits derived therefrom.

The following are specific examples of preferred additives of sub-micron size. Aluminum oxide C having an average particle size of 0.020 micron, and titanium dioxide P25 having an average particle size of 0.030 micron, both available from Degussa, Inc., Pigments Division, 2 Penn Plaza, New York, N.Y. 10001. Cab-O-Sil fumed silica ($SiO_2$) having an average particle size of 0.007–0.012 micron, available from Cabot Corp., 125 High Street, Boston, Mass. 02110. Tullanox 500 (hydrophobic fumed silica) having an average particle size of 0.007 micron, available from Beacon CMP Corp., 1485 Morris Avenue, Union, N.J. 07087.

Although the invention has been described with respect to a specific embodiment it will be appreciated that modifications and changes may be made by those skilled in the art without departing from the true spirit and scope of the invention. For example, in FIG. 1, it is only necessary to coat one of the lead-in wires with glass frit insulation, although the described dip coating method renders the covering of both leads the most feasible approach. Clearly the concept is also applicable to axial lamps with the two lead-in wires entering opposite ends thereof. Further the scraped off areas 14 may be located on the outside surfaces of the pair of wires rather than opposing inside areas. On the other hand, both the inside and outside surfaces may be scraped. With respect to the primer material, it is apparent that a wide variety of inert materials may be employed as the additive, provided they are insoluble and non-conductive and have a particle size less than about 5 microns diameter.

What we claim is:

1. A photoflash lamp comprising:

an hermetically sealed, light-transmitting envelope;

a quantity of filamentary combustible material located within said envelope;

a combustion-supporting gas in said envelope;

and a non-filament type ignition means disposed in said envelope in operative relationship with respect to said combustible fill material and adapted to be ignited by a high voltage pulse, said ignition means including a pair of lead-in wires extending into said envelope in a spaced relationship, and a dried coating of primer material covering a portion of at least one of said lead-in wires within said envelope, said coating of primer material having been provided from a mixture comprising a particulate fuel, a binding agent, a solvent and an additive of finely divided inert material, said finely divided inert material being insoluble in said solvent and nonconductive and having a particle size of less than about 0.5 micron diameter, the particle size of said additive of inert material being substantially finer than the particle size of said fuel whereby said additive becomes distributed in the interstices between the larger fuel particles of the final mixture and the sensitivity and reliability of said primer material is significantly enhanced.

2. The lamp of claim 1 wherein said combustion-supporting gas in said envelope is oxygen at an initial fill pressure exceeding one atmosphere.

3. The lamp of claim 1 wherein said inert material additive is present in said primer material mixture in an amount of from about 0.1 to 20.0 percent by weight on a dried basis.

4. The lamp of claim 3 wherein said inert material additive is present in said primer material mixture in an amount of from about 3.0 to 6.0 percent by weight on a dried basis.

5. The lamp of claim 1 wherein said fuel is a combustible metal powder.

6. The lamp of claim 5 wherein said fuel is zirconium powder.

7. The lamp of claim 6 wherein said inert material is selected from the group consisting of titanium dioxide, aluminum oxide, silicon dioxide, aluminum silicate clays, and magnesium oxide.

8. The lamp of claim 1 wherein said inert material is selected from the group consisting of fumed silica, fumed alumina, and fumed titania and has a particle size of about 0.01 to 0.02 micron diameter.

9. The lamp of claim 1 wherein the termination of each of said lead-in wires within said envelope has a smooth and rounded configuration of larger diameter than the remainder of the wire, an insulating material is coated on substantially the full length within the envelope of at least one of said lead-in wires for preventing preignition short circuits through said filamentary combustible material, and said primer material is coated about the smooth and rounded terminations of said lead-in wires, the primer coating on the insulatingly coated lead-in wire being disposed over said coating of insulating material.

10. The lamp of claim 9 wherein said primer material bridges the terminations of said lead-in wires.

11. The lamp of claim 9 wherein the respective primer coatings on said lead-in wires are spaced apart from each other, and said filamentary combustible material substantially fills said envelope and is in contact with both of said respective primer coatings so as to form an electrically conducting path therebetween for formation of a spark discharge between said lead-in wires and the combustible material through said respective primer coatings upon application of a high voltage pulse across said lead-in wires.

12. The lamp of claim 1 further including a sleeve of insulating material extending within said envelope about one of said lead-in wires, said sleeve being sealed to said envelope at one end and open at the other end, the other of said lead-in wires terminating at one near the open end of said sleeve, and said primer material being disposed to substantially cover the open end of said sleeve and bridge the ends of said lead-in wires.

13. The lamp of claim 1 wherein said primer material further includes one or more oxides of metals having a boiling point above 2000° C., said metal oxides being substantially non-conductive electrically and having a lower free energy of formation that the oxides of the fuel, the proportion of said metal oxides is from about 1% to 130% of the stoichiometric quantity required for chemical reaction with the powdered metal fuel in the mixture, and said primer material being free of oxidizer salts.

14. The lamp of claim 13 wherein said fuel includes magnesium powder, the proportion of magnesium powder in said primer mixture being from about 0% to 30% by weight on a dried basis.

* * * * *